US011015317B2

(12) United States Patent
Elbel et al.

(10) Patent No.: US 11,015,317 B2
(45) Date of Patent: May 25, 2021

(54) EXCAVATOR BOOM AND EXCAVATOR

(71) Applicant: Liebherr-France SAS, Colmar (FR)

(72) Inventors: Guillaume Elbel, Colmar (FR); Johan Pleimelding, Biesheim (FR); Thomas Münch, Reiningue (FR)

(73) Assignee: Liebherr-France SAS, Colmar (FR)

( * ) Notice: Subject to any disclaimer, the term of this patent is extended or adjusted under 35 U.S.C. 154(b) by 35 days.

(21) Appl. No.: 16/130,907

(22) Filed: Sep. 13, 2018

(65) Prior Publication Data

US 2019/0085527 A1 Mar. 21, 2019

(30) Foreign Application Priority Data

Sep. 15, 2017 (DE) ..... 10 2017 121 518.2

(51) Int. Cl.
*E02F 3/38* (2006.01)
*E02F 9/08* (2006.01)

(52) U.S. Cl.
CPC ..... *E02F 3/382* (2013.01); *E02F 3/38* (2013.01); *E02F 9/0825* (2013.01); *Y10T 29/49622* (2015.01)

(58) Field of Classification Search
CPC ..... E02F 3/382; E02F 9/0825
See application file for complete search history.

(56) References Cited

U.S. PATENT DOCUMENTS

| | | | | |
|---|---|---|---|---|
| 4,069,637 | A | 1/1978 | Braithwaite | |
| 5,152,659 | A | 10/1992 | Waka | |
| 6,637,111 | B2 * | 10/2003 | Sasaki | E02F 3/38 29/891 |
| 10,378,182 | B2 * | 8/2019 | Elbel | E02F 3/382 |
| 2008/0187427 | A1 | 8/2008 | Durney | |
| 2013/0177375 | A1 * | 7/2013 | Crane | E02F 3/382 414/722 |

FOREIGN PATENT DOCUMENTS

| | | | | |
|---|---|---|---|---|
| JP | 53-31539 B1 | * | 3/1978 | |
| JP | 55-4454 | * | 1/1980 | |
| JP | 58-69050 U | * | 5/1983 | |
| JP | 59-107657 U | * | 7/1984 | |
| JP | 61-6552 U | * | 1/1986 | |
| JP | 11158907 A | * | 6/1999 | |
| JP | H11158907 A | | 6/1999 | |
| JP | 2000248574 A | | 9/2000 | |
| JP | 2000248573 A | * | 12/2000 | E02F 3/38 |
| JP | 2008240343 A | | 10/2008 | |

* cited by examiner

*Primary Examiner* — Gerald McClain
(74) *Attorney, Agent, or Firm* — McCoy Russell LLP

(57) ABSTRACT

A boom for an earth-moving machine, in particular an excavator, comprising rear and front boom parts that are cohesively assembled to form a boomerang-like boom structure, wherein the central connection between the boom parts is formed by a simple thick central connecting plate.

17 Claims, 2 Drawing Sheets

EXCAVATOR BOOM AND EXCAVATOR

CROSS REFERENCE TO RELATED APPLICATION

This application claims priority to German Patent Application No. 10 2017 121 518.2, entitled "EXCAVATOR BOOM AND EXCAVATOR," filed Sep. 15, 2017, the entire contents of which is hereby incorporated by reference in its entirety for all purposes.

TECHNICAL FIELD

This invention relates to a boom for an earth-moving machine, in particular an excavator, which is cohesively assembled from a rear boom part and a front boom part to form a boomerang-like boom structure.

BACKGROUND AND SUMMARY

Generic boom forms are known from the prior art. For the construction of such boom structures a front boom box usually is connected to a rear boom box via a special connecting element. By way of example, reference is made to the U.S. patent specification U.S. Pat. No. 4,069,637. A corresponding manufacturing method is known from U.S. Pat. No. 6,637,111 B2. The solutions disclosed there, however, have in common that an expensive construction of the used connecting piece is necessary. This does not only increase the incurred production costs and the total weight of the boom, but the design of the connection between the boom parts also turns out to be relatively inflexible, in particular as regards the desired angle of the two boom parts relative to each other.

Therefore, solutions for the generic boom are sought for, by means of which the abovementioned problems can be overcome.

This object is solved by a boom for an earth-moving machine, in particular an excavator, comprising rear and front boom parts that are cohesively assembled to form a boomerang-like boom structure, wherein the central connection between the boom parts is formed by a central connecting plate. Advantageous aspects of the boom are subject-matter of the dependent claims.

Proceeding from the generic boom for an earth-moving machine, in particular an excavator, it is proposed to cohesively connect the front and the rear boom part to each other by means of at least one central connecting plate. The construction of the central connecting element thereby is much simpler, less expensive and of lower weight. In general, the total construction of the boom is simplified distinctly. The use of the connecting plate also offers more degrees of freedom for the connection of the boom parts, in particular as regards their angle to each other and also their construction itself, here in particular the desired profile shape of the boom parts, their material thickness and the size of the cross-sectional areas.

The central connecting plate can be made in one part. It is also possible, however, to assemble the central connecting plate from one or more individual plates.

Ideally, the central connecting plate forms the contact surface between the two boom parts. The central connecting plate can form the end face of the front and/or rear boom part. The central connecting plate can be a simple thick plate. In particular, the plate thickness is greater than the wall thickness of the boom parts.

The front and/or rear boom part preferably provides a linear structure, preferably said boom parts have a linear middle axis. Both boom parts are connected with each other at a determinable angle to each other, so that the desired boomerang-like shape is obtained. In the mounting position, the front boom part is angled downwards with respect to the middle axis of the rear boom part. The chosen angle can be acute, but this is not a necessary prerequisite.

The rear boom part serves for mounting on the earth-moving machine, preferably on the uppercarriage and/or undercarriage of the earth-moving machine. Accordingly, corresponding bearing points are provided at the outer end of the rear boom part for luffably mounting on the earth-moving machine. The front boom element preferably comprises bearing points at its outer end for fastening a boom extension and/or an attachment.

According to a particularly preferred embodiment the central connecting plate is curved, whereby possibly a curved contact edge of the boom parts along the boom side faces can be obtained.

It can also be advantageous when at least one upper connecting plate is provided, which forms a part of the boom upper side in the connecting region of the two boom parts. In particular, this upper connecting plate is characterized by a curved plane, whereby the angle between the boom parts likewise can be specified by means of the connecting plate.

The front and/or rear boom part can be designed as a box structure, in particular as a hollow box structure. Preferably, the same at least sectionally have a corresponding box shape. The fabrication of the boom parts themselves can be effected by a fillet welding method, whereby the side parts of the boom part are assembled to obtain the desired box shape.

It is imaginable when the cross-sectional profiles of the boom parts are different in the connecting region. What is conceivable for example is a distinction of the resulting cross-sectional areas of the front and rear boom parts. Ideally, the cross-sectional area of the front boom part is larger in area than the cross-sectional area of the rear boom part. It is particularly preferred when the boom profile of the front boom part is broader than the profile of the rear boom part. The required wall thickness of the front and/or rear boom part and/or of the connecting plate can thereby be reduced without having to accept an impairment of the boom stiffness. In total, this leads to a further significant reduction in weight of the total construction.

According to a particularly preferred embodiment of the invention it can be provided that in the connecting region of the boom parts at least one bearing point is provided for accommodating an actuator. In particular, a bearing point for articulating a luffing cylinder of the earth-moving machine is provided in this region. Preferably, at least one bearing point is arranged on the central connecting plate, in particular welded thereto. Thereby, the stiffness of the boom can be increased.

The bearing point welded to the central connecting plate can be designed as a bearing tube for accommodating corresponding bearing bolts, wherein the bearing tube extends through one of the boom parts transversely to the longitudinal boom axis. The outlet openings of the bearing tube then are located on the side faces of the boom part. In the region of this outlet opening one or more reinforcing plates can be arranged. Expediently, the bearing tube extends through the rear boom part. The bearing tube and/or the reinforcing plates can be realized in a cast casting. What is conceivable is the manufacture of this combination also by machining an output part.

Furthermore, the boom can comprise one or more bearing points for accommodating an actuator, preferably a linear actuator such as a cylinder unit, for actuating a boom extension movably mounted on the front boom part and/or an attachment mounted thereon. One or more bearing points preferably are arranged directly at or on the upper connecting plate. The bearing point can be formed in the form of at least two bearing plates that are perpendicularly welded to the upper connecting plate. Usually, the same are aligned parallel to each other and extend in parallel in the longitudinal direction of the boom. The arrangement of the bearing plates on the upper connecting plate increases the material stiffness in this region, which leads to an improvement of the stability in the connecting point of the two boom parts.

It is particularly preferred when the bearing plates extend from the upper connecting plate to the rear boom part. In this case, the end of the bearing plates lies in a region of reduced stress, so that the welding seam present there does not require an additional treatment or reinforcement.

Beside the inventive boom for an earth-moving machine the present invention also relates to an earth-moving machine, in particular an excavator, with at least one boom according to the present invention. Correspondingly, the earth-moving machine is characterized by the same advantages and properties as they have already been explained above with reference to the boom according to the invention. A repetitive description will be omitted for the sake of simplicity.

Further advantages and properties of the invention will be explained in detail below with reference to an exemplary embodiment illustrated in the Figures.

FIG. 1 shows a perspective top view of an excavator boom according to the invention, FIG. 2 shows a detail view of the connecting point between the front and rear excavator boom parts, FIG. 3 shows a detail view of the connecting region of FIG. 2 with an open side face of the boom arm.

BRIEF DESCRIPTION OF THE FIGURES

The perspective side view of FIG. 1 shows the total construction of the excavator boom 10 according to the invention. The same consists of a front boom part 11 and a rear boom part 12. At the front boom part connecting points 34 are provided for movably mounting a non-illustrated attachment or a boom extension. The rear boom part 12 comprises corresponding bearing points 16 at its end in order to be able to luffingly articulate the same to an excavator uppercarriage or undercarriage.

Both the rear and the front boom part can be fabricated as a monoblock. It is likewise possible, however, to assemble the boom parts 11, 12 from individual elements.

DETAILED DESCRIPTION

Figure 1:
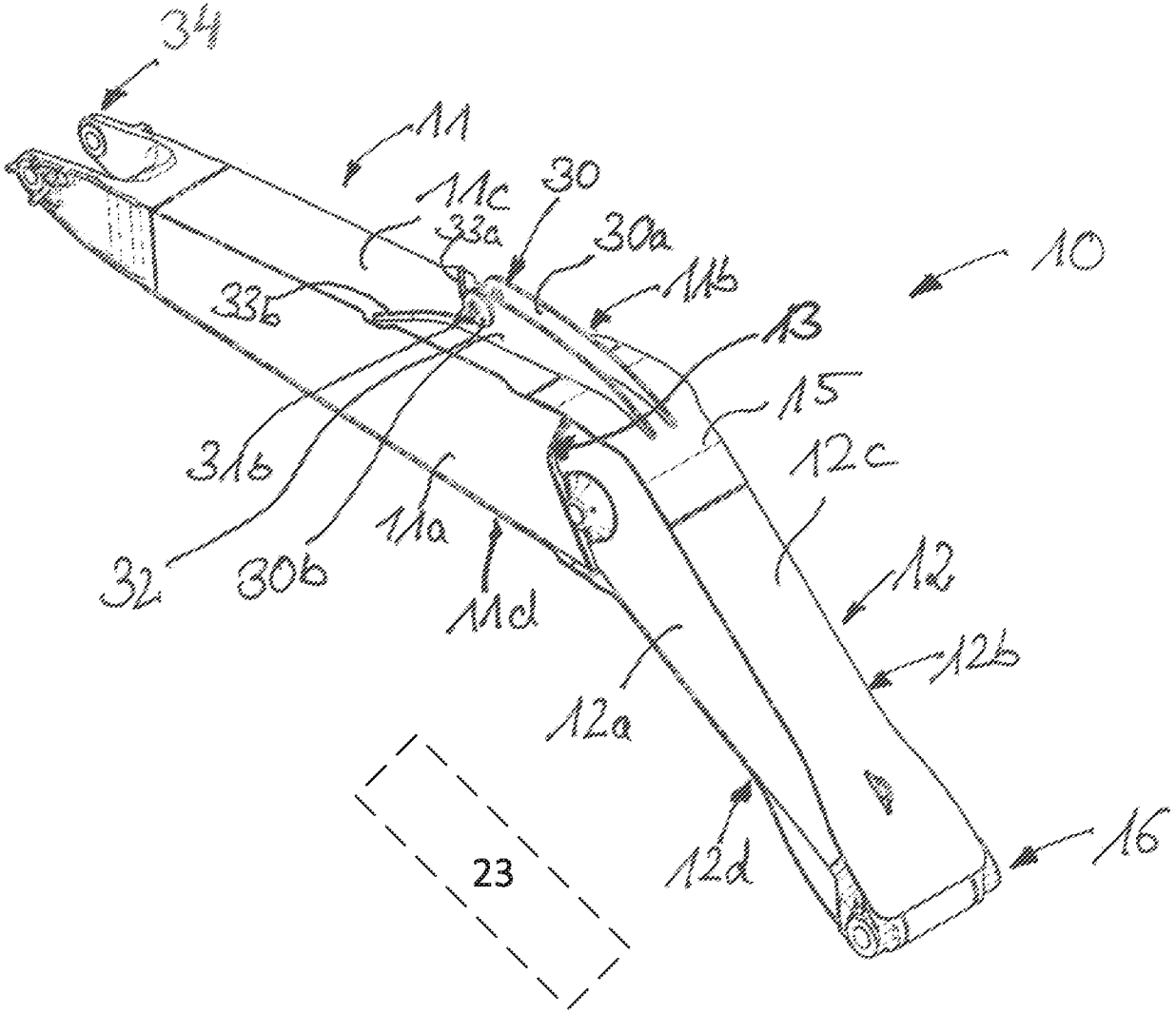

Both boom parts 11, 12 have a box-shaped structure that is obtained by welding together corresponding side plates. The individual side plates 11*a* to 11*d* and 12*a* to 12*d* are welded together by a fillet welding method.

The connection between the two boom parts 11, 12 is created by the central connecting plate 13, wherein at least the front edges of the side plates 11*a*, 11*b* and 12*a*, 12*b* and possibly of the undersides 11*d* and 12*d* are cohesively connected to each other via the connecting plate 13. The connecting plate 13 has a curved shape, whereby possibly a curved contact edge of the boom parts 11, 12 is obtained along the side plates 11*a*, 11*b*, 12*a*, 12*b*. The connecting plate 13 is designed as a simple, thick plate. It allows a simple connection between the boom parts 11, 12 and correspondingly a simple adaptation to the desired angle that is formed by the two boom elements 11, 12. In addition, it is also possible to flexibly react to the desired width of the box-shaped boom parts 11, 12, i.e. the width of the respective side faces 11*c*, 12*c*. The construction according to the invention leads to a distinct reduction of the incurred manufacturing costs and the resulting total weight of the boom 10.

In the region of the boom upper side the boom surfaces 11*c* and 12*c* of the boom parts 11, 12 are not directly connected with each other. Instead, a plate-shaped upper connecting plate 15 is inserted here or overlappingly placed on the upper sides 11*c*, 12*c* and welded to the two boom parts 11, 12. The plate-shaped upper connecting plate 15 is bent corresponding to the angle formed by the two boom parts 11, 12 relative to each other. Possibly, the boom underside might also be designed with a corresponding connecting element.

Figure 2:
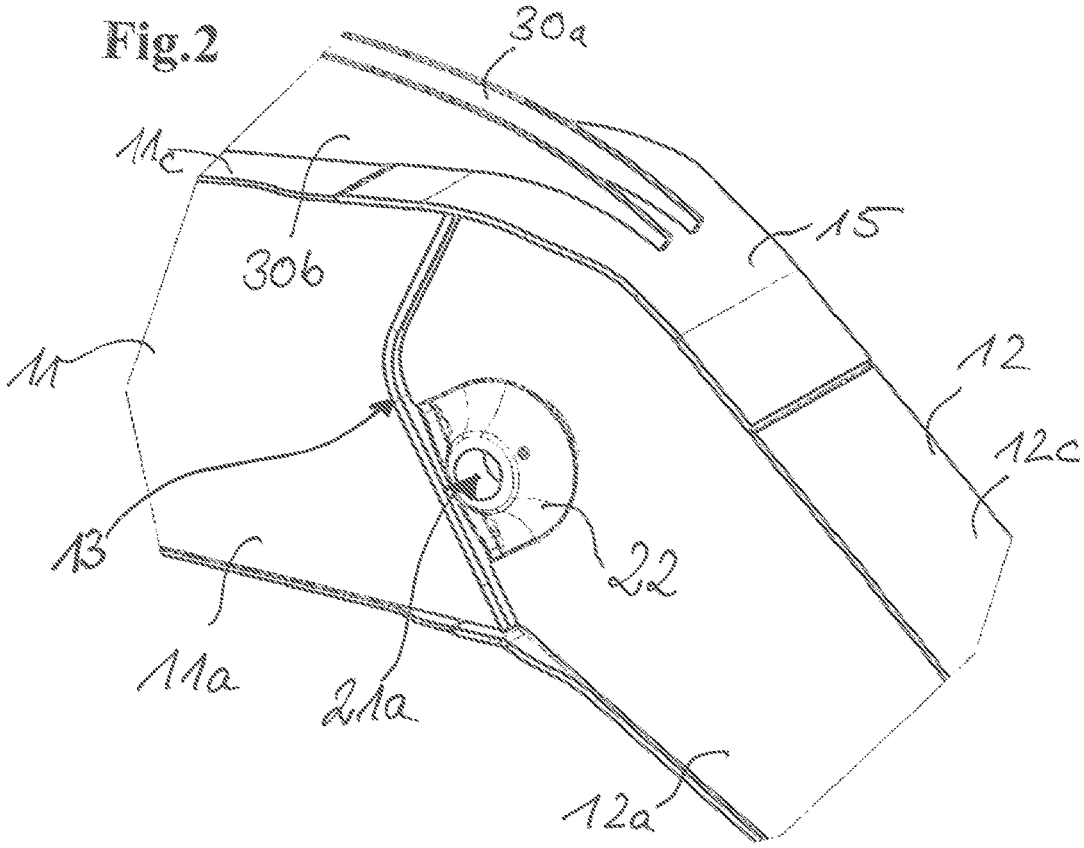
Figure 3:
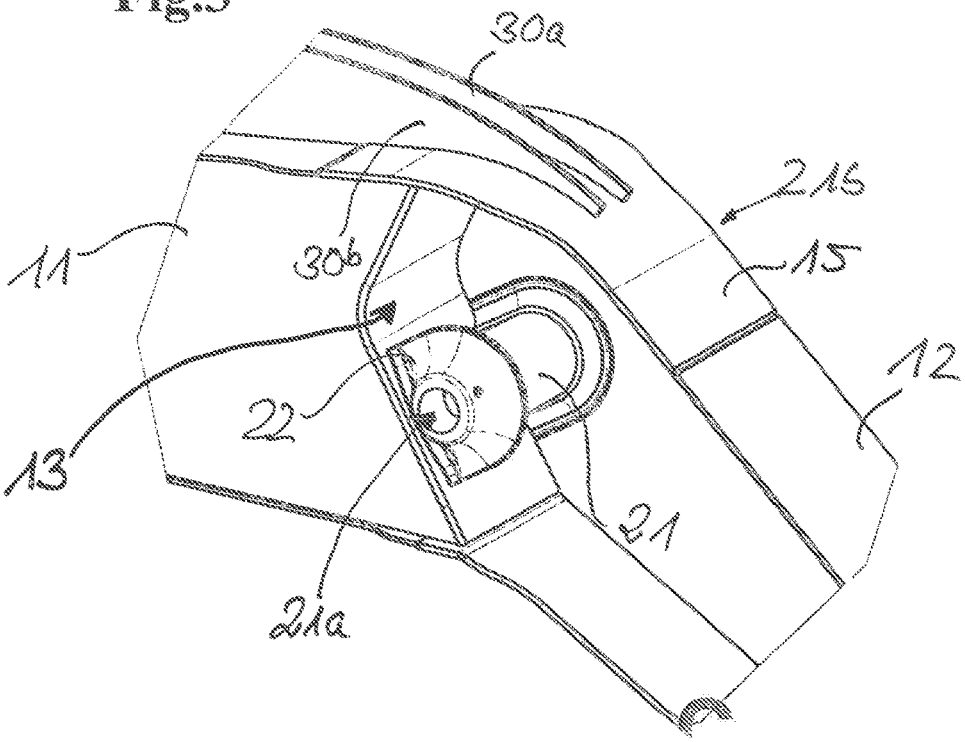

As shown in FIGS. 2 and 3, in the region of the rear boom part 12 a cylindrical tube 21 extends through the boom box 12 transversely to the longitudinal boom axis, which is welded to the central connecting plate 13. Mounting the bearing tube 21 on the central connecting plate 13 at the same time ensures that the total stiffness of the boom can additionally be increased. Via outlet openings 21*a*, 21*b* within the side elements 12*a*, 12*b* an appropriate bolt can be put into the cylinder tube 21. In the region of the outlet openings 21*a*, 21*b* additional reinforcing plates 22 are also mounted on the outside of the side plates 12*a*,12*b*. The tube 21 forms the bearing point for the connection of an actuator or luffing cylinder 23, depicted schematically, of the excavator according to the invention, which extends from the bearing point 21 of the rear boom part 12 to the uppercarriage of the excavator. Luffing cylinders may also be referred to as hoist cylinders or boom cylinders.

For supporting a further hydraulic adjusting means in the form of a hydraulic cylinder an additional bearing point 30 is provided on the upper side of the boom 10, which provides for accommodating a cylinder that extends from the bearing point 30 up to an attachment accommodated at the bearing point 13.

The bearing point 30 consists of two bearing plates 30*a*, 30*b* extending in parallel, which are perpendicular to the boom upper side and extend parallel in the longitudinal direction of the boom. In the region with the largest width, a bore 31*a*, 31*b* each is provided for accommodating a bolt, wherein the bore edge is reinforced with additional plates 32. The width of the bearing plates 30*a*, 30*b* steadily decreases in the direction of the rear boom part 12. The majority of the bearing plates including the bores 31*a*, 31*b* are arranged on the upper side 11*a* of the front boom part 11, but both plates 30*a*, 30*b* extend in parallel except for the upper connecting plate 15 to which the plate ends are welded. The extension of the bearing plates 30*a*, 30*b* up to the connecting plate 15 has the advantage that the end of the formed welding seam lies in a region of the boom to which less force is applied, whereby not only the material fatigue resistance can be increased, but manufacturing costs also can be lowered, as in this case no additional aftertreatment of the welding seam is necessary.

Furthermore, it can be seen that the width of the bearing plates 30*a*, 30*b* after the bore 31*a*, 31*b* abruptly decreases in the direction of the boom tip and then remains almost constant. These bearing plate portions 33*a*, 33*b* of reduced, but almost constant width have a curvature so that the plate portions 33*a*, 33*b* do not extend parallel to each other, but outwardly to the edges of the surface 11*c* of the front boom part 11.

The upper plate 11*a* of the front boom part 11 can be broadened in the region of the bearing plate portions 33*a*, 33*b* adjoining the edge so that the plate elements 33*a*, 33*b* can protrude beyond the actual edge of the front boom part. Due to the bend of the bearing plates 30*a*, 30*b* the total stiffness of the bearing can be increased, but without having to increase the thickness of the bearing plates 30*a*, 30*b*. In addition, it is not necessary either to mount further reinforcing plates in the region of the bearing point. Thereby, the total weight of the boom can further be reduced and its manufacture can further be simplified.

The invention claimed is:

1. A boom for an earth-moving machine, comprising:

a rear boom part comprised of an upper surface, a lower surface, and two side surfaces, a front boom part comprised of an upper surface, a lower surface, and two side surfaces, the front and rear boom parts cohesively assembled to form a structure which curves at a central connection, and the central connection between the boom parts formed by a central connecting plate extending transversely through the structure and each side surface of each of the front and rear boom parts are connected to the central connecting plate, wherein the central connecting plate is curved in the front-rear direction, and wherein the rear of the front boom part and the front of the rear boom part are disposed on the central connecting plate.

2. The boom according to claim 1, wherein the central connecting plate is a one-part plate or is assembled from a plurality of individual plates.

3. The boom according to claim 1, wherein the central connecting plate forms an end face of the front and/or rear boom part, wherein the central connecting plate is curved, whereby a curved contact edge of the boom parts is obtained along the boom side faces.

4. The boom according to claim 1, wherein at least one upper connecting plate forms a boom upper side at the central connection, the upper connecting plate is connected to the front boom part at a first end and the rear boom part at a second end, and the upper connecting plate has a curved shape.

5. The boom according to claim 1, wherein the front and rear boom parts as well as the central and/or an upper connecting plate are welded together.

6. The boom according to claim 5, wherein the front and rear boom parts and the central and/or upper connecting plate are welded together by fillet welding.

7. The boom according to claim 1, wherein the front and/or rear boom part have a box structure with a rectangular cross-sectional profile.

8. The boom according to claim 1, wherein one or more bearing points for at least one actuator are arranged directly on the central connecting plate, wherein bearing points are formed by a tube for accommodating a bearing bolt extending through boom side faces transversely to the longitudinal boom axis.

9. The boom according to claim 8, wherein in the region of the outlet openings of the tube reinforcing plates are provided on the side faces, wherein the reinforcing plates and/or the tube is/are manufactured as a common casting or machined part.

10. The boom according to claim 1, wherein on an upper connecting plate one or more bearing points are provided for accommodating an actuator for actuating a boom extension and/or an attachment, wherein the at least one bearing point comprises at least two bearing plates at least sectionally arranged parallel to each other, which are welded perpendicularly to the upper connecting plate, and wherein these bearing plates diverge towards the end in the longitudinal direction of the boom.

11. The boom according to claim 10, wherein the actuator is a cylinder unit.

12. The boom according to claim 8, wherein the at least one actuator is a hoist cylinder, wherein the actuator is welded on the central connecting plate, and wherein tube openings exit through the side faces of the rear boom part.

13. The boom according to claim 1, wherein the cross-sectional profiles of the boom parts are different in the connecting region.

14. The boom according to claim 13, wherein the cross-sectional area of the front boom part is larger in area than the cross-sectional area of the rear boom part.

15. The boom according to claim 1, wherein the earth-moving machine is an excavator.

16. An earth-moving machine with at least one boom, the machine comprising:

a rear boom part comprised of an upper surface, a lower surface, and two side surfaces, and a front boom part comprised of an upper surface, a lower surface, and two side surfaces, the front and rear boom parts that are cohesively assembled to form a structure which curves at a central connection, wherein the central connection between the boom parts formed by a central connecting plate extending transversely through the structure and each side surface of each of the front and rear boom parts are connected to the central connecting plate, wherein the central connecting plate is curved in the front-rear direction, and wherein the rear of the front boom part and the front of the rear boom part are disposed on the central connecting plate.

17. The earth-moving machine according to claim 16, wherein the earth-moving machine is an excavator.

* * * * *